US012043425B2

(12) United States Patent
Diederiks et al.

(10) Patent No.: US 12,043,425 B2
(45) Date of Patent: Jul. 23, 2024

(54) METHOD AND DEVICE FOR TENSIONING

(71) Applicant: CORDSTRAP B.V., Oostrum (NL)

(72) Inventors: Elmo Diederiks, Oostrum (NL); Perry Van Berlo, Oostrum (NL)

(73) Assignee: CORDSTRAP B.V., Oostrum (NL)

( * ) Notice: Subject to any disclaimer, the term of this patent is extended or adjusted under 35 U.S.C. 154(b) by 246 days.

(21) Appl. No.: 17/753,075

(22) PCT Filed: Aug. 28, 2020

(86) PCT No.: PCT/EP2020/074120
§ 371 (c)(1),
(2) Date: Feb. 17, 2022

(87) PCT Pub. No.: WO2021/038067
PCT Pub. Date: Mar. 4, 2021

(65) Prior Publication Data

US 2022/0297861 A1 Sep. 22, 2022

(30) Foreign Application Priority Data

Aug. 30, 2019 (NL) ..... 2023736
Sep. 20, 2019 (NL) ..... 2023865

(51) Int. Cl.
*B65B 13/22* (2006.01)
*B65B 13/34* (2006.01)
*B65B 57/00* (2006.01)

(52) U.S. Cl.
CPC ..... *B65B 13/22* (2013.01); *B65B 13/345* (2013.01); *B65B 57/00* (2013.01)

(58) Field of Classification Search
CPC ..... B65B 13/187; B65B 13/22; B65B 13/025; B65B 13/345; B65B 57/00
See application file for complete search history.

(56) References Cited

U.S. PATENT DOCUMENTS

| | | | | |
|---|---|---|---|---|
| 4,901,775 | A | 2/1990 | Scott et al. | |
| 2009/0114308 | A1* | 5/2009 | Marelin | B65B 13/185 140/93.4 |
| 2013/0269824 | A1 | 10/2013 | Skonieczny, Jr. et al. | |
| 2017/0008652 | A1* | 1/2017 | Figiel | G05B 19/0426 |

FOREIGN PATENT DOCUMENTS

| | | | | |
|---|---|---|---|---|
| NL | 2018860 | B1 * | 5/2018 | |
| NL | 2018860 | B1 | 5/2018 | |
| WO | 2009129636 | A1 | 10/2009 | |
| WO | 2016209718 | A1 | 12/2016 | |
| WO | WO-2016209718 | A1 * | 12/2016 | B65B 13/025 |
| WO | 2017/112002 | A1 | 6/2017 | |

OTHER PUBLICATIONS

International Search Report issued in PCT/EP2020/074120, mailed Dec. 3, 2020.

* cited by examiner

*Primary Examiner* — Anna K Kinsaul
*Assistant Examiner* — Himchan Song
(74) *Attorney, Agent, or Firm* — ICE MILLER LLP

(57) ABSTRACT

The current invention relates to a method and a device for tensioning bands. In particular, as soon as a predetermined tension level has been reached, the tensioning motor and tensioning means of the device are automatically actuated in a reverse direction.

18 Claims, 2 Drawing Sheets

METHOD AND DEVICE FOR TENSIONING

CROSS-REFERENCE TO RELATED PATENT APPLICATIONS

This is a U.S. National Phase Application under 35 U.S.C. § 371 of International Patent Application No. PCT/EP2020/074120, filed Aug. 28, 2020, and claims priority to Netherlands Patent Application No. NL2023736, filed Aug. 30, 2019, and Netherlands Patent Application No. NL2023865, filed Sep. 20, 2019, which are incorporated by reference in their entireties. The International Application was published on Mar. 4, 2021, as International Publication No. WO 2021/038067 A1.

FIELD OF THE INVENTION

The present invention relates to methods and devices for tensioning bands such as strapping bands and lashing bands, for instance for securing goods.

The invention is especially concerned with the lashing of loads during transport, using battery-driven tensioning devices. However, the invention may generally relate to both strapping and lashing.

BACKGROUND

Strapping is used to create a transportable unit. Lashing is used to secure cargo for transportation with the goal of minimizing shifting and/or tipping.

Tensioning devices for strapping have been disclosed in WO 2017 112 002, WO 2016 209 718, and in WO 2009 129 636. First, a strap is tensioned around an object. Second, some kind of seal is applied. In particular, WO 2017 112 002 provides a tensioning device that may apply tension up to a certain level.

A number of problems in relation to known tensioning devices are:

- The user is generally not aware of the tension in the band. Quite often, the user therefore continues to activate the tensioning device beyond its capacity, and/or beyond the tension level actually needed. The latter is not effective but will surely affect battery and electro-motor life.
- Depending on the seal mechanism (welded seal, crimped seal, interlocking seal, self-locking buckle), the user may be required to subsequently release tension in the free end portion of the band. This requires additional actions.
- In some cases power supply is suddenly cut, e.g. when the tensioning device is suddenly de-activated at a predetermined tension level. The free end portion of the band may then "pull back" the tensioning means (e.g. a tensioning wheel or windlass) to some extent, opposite to the tensioning direction. This may cause the tensioning motor to act as a generator. Currents and/or voltages may reach high levels. As a drawback, the device should be able to cope with such currents and/or voltages.

The present invention aims to resolve one or more of the above mentioned problems.

SUMMARY OF THE INVENTION

To such end, the present invention provides a method according to claim 1, for tensioning a strapping band or a lashing band. In particular, as soon as a predetermined tension level has been reached, the tensioning motor and the tensioning means (e.g. a slotted windlass or tension wheel) are automatically actuated in a reverse direction of rotation.

An immediate auto-reverse of the tensioning means, and thus an immediate de-tensioning of the free end portion of the band is provided. This is very advantageous, both in terms of timesaving and user convenience. The user does not have to switch the tensioner in reverse manually, which saves time. Also, the user is restrained from further tensioning the band, beyond said predetermined tension level.

Preferably, the actual tension level is monitored while tensioning. When the tension in the band reaches a predetermined tension level, the tensioner motor is automatically, immediately & actively actuated in reverse, so as to reverse the tensioning means to release the tension in the free end portion of the band (w.r.t. the buckle). Since a self-locking buckle (e.g. a ladder buckle, cam buckle, or wire buckle) is employed, no separate seal needs to be applied. Tension in the free end portion of the band may be released immediately. Tension in the main portion of the band is maintained by the self-locking buckle.

Further advantages relate to more efficient use of energy, no peaks in current/voltage that can harm the motor, the battery and/or the driving electronics, and in time savings for the user. In particular, since the motor is actuated in reverse, any current/voltage peaks that may arise will be less harmful to the motor, the battery and/or to the driving electronics.

The inventors found that, especially for lashing systems where more rigid lashing bands are employed, and where higher tension levels may be involved, and especially in case a slotted windlass is used as tensioning means, releasing the free end portion via reverse rotation of the windlass is highly effective for releasing the (lashing) bands from the windlass. Moreover, alternative ways for releasing the windlass, such as cutting the free end portion of the band, may be less practical in case of lashing. As mentioned above, lashing bands are typically stronger and more rigid. Cutting free end portions of such lashing bands could unduly burden the lashing operation. However, the invention is generally not limited to tensioning devices either with or without such cutting mechanism(s).

The invention further provides a tensioning device according to claim 10, and a tensioning kit according to claim 15.

DETAILED DESCRIPTION OF THE INVENTION

Figure 1:
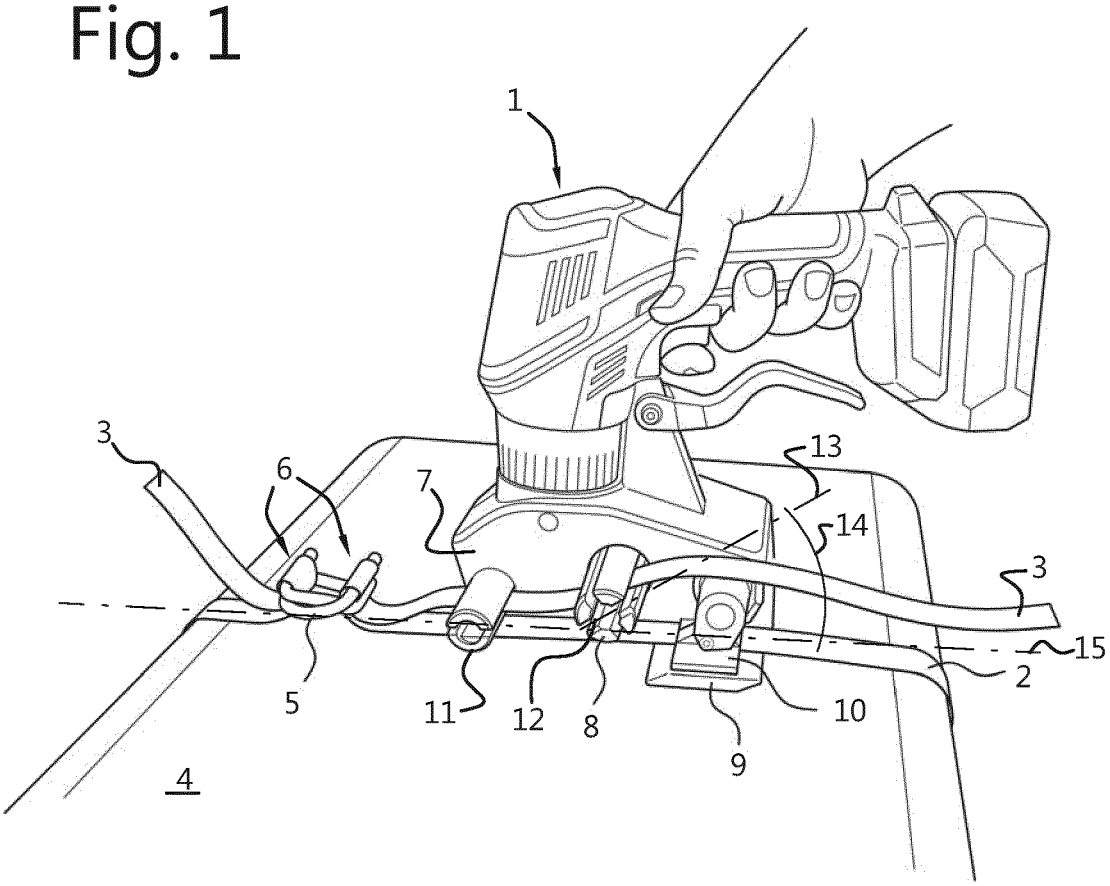
FIG. 1 represents a tensioning device according to an embodiment of the invention, used for tensioning a band around an object.

The present invention concerns a method and a device for securing loads.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"About" as used herein referring to a measurable value such as a parameter, an amount, a temporal duration, and the like, is meant to encompass variations of +/−20% or less, preferably +/−10% or less, more preferably +/−5% or less, even more preferably +/−1% or less, and still more preferably +/−0.1% or less of and from the specified value, in so far such variations are appropriate to perform in the disclosed invention. However, it is to be understood that the value to which the modifier "about" refers is itself also specifically disclosed.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Furthermore, the terms first, second, third and the like in the description and in the claims, are used for distinguishing between similar elements and not necessarily for describing a sequential or chronological order, unless specified. It is to be understood that the terms so used are interchangeable under appropriate circumstances and that the embodiments of the invention described herein are capable of operation in other sequences than described or illustrated herein.

The recitation of numerical ranges by endpoints includes all numbers and fractions subsumed within that range, as well as the recited endpoints.

The expression "% by weight", "weight percent", "% wt" or "wt %", here and throughout the description unless otherwise defined, refers to the relative weight of the respective component based on the overall weight of the formulation.

Whereas the terms "one or more" or "at least one", such as one or more or at least one member(s) of a group of members, is clear per se, by means of further exemplification, the term encompasses inter alia a reference to any one of said members, or to any two or more of said members, such as, e.g., any ≥3, ≥4, ≥5, ≥6 or ≥7 etc. of said members, and up to all said members.

Unless otherwise defined, all terms used in disclosing the invention, including technical and scientific terms, have the meaning as commonly understood by one of ordinary skill in the art to which this invention belongs. By means of further guidance, definitions for the terms used in the description are included to better appreciate the teaching of the present invention. The terms or definitions used herein are provided solely to aid in the understanding of the invention.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Preferably, a "self-locking buckle" is generally understood as any type of band fitting that provides at least one band-engaging portion. A band threaded through the buckle may be tensioned via at least one free end portion of the band, said free end portion leaving the buckle. In particular, tension in the main band portion is substantially maintained by the buckle when releasing said free end portion. I.e. the buckle is "self-locking". Non-limiting embodiments of self-locking buckles include ladder buckles, wire buckles, and cam buckles. At first instance, however, the invention is not limited to any of these.

A "loading plan" as used herein generally comprises information relating to the goods or load to be secured (e.g. mass, volume, . . . ) and to the load configuration/pattern according to which the goods or load is applied. In any case, information contained in the loading plan should suffice for determining the required band type(s), buckle type(s), and tensioning level(s). This information may also be contained in the so-called (digital) shipping document. For instance, the required band types, buckle types, and tensioning levels could be calculated by means of information contained in the loading plan. However, the invention is generally not limited thereto.

"Tensioning direction", as used herein, generally relates to a direction of movement of the tensioning means in which a portion of a band (engaged by said tensioning means) is tensioned. "Reverse direction", as used herein, generally relates to a direction of movement of the tensioning means in which said portion of the band is at least partly released or relaxed. Said reverse direction may or may not be substantially opposite to said tensioning direction. It is generally understood by the skilled person that "direction of movement" and "sense of movement" may be used as synonyms.

In non-limiting embodiments according to which the tensioning means is a rotary tensioning means, the aforementioned directions of movement are preferably rotary directions of movement. The tensioning direction therein preferably corresponds to a rotation direction or sense in which said portion of the band is tensioned. Also, the reverse direction therein preferably corresponds to a rotation direction or sense in which said portion of the band is at least partly released or relaxed. Said rotation directions may be substantially opposite to one another.

In a first aspect, the invention provides a method for tensioning a strapping band or a lashing band, which band is threaded through a self-locking buckle, and wherein said method comprises the steps of:

- engaging a free end portion of the band via a tensioning means of a tensioning device, said tensioning device comprising a tensioning motor operatively connected to said tensioning means, and
- tensioning said band by actuating said tensioning motor in a tensioning direction, thereby driving said tensioning means, and thereby pulling said free end portion of the band through said buckle.

In particular, as soon as a predetermined tension level has been reached, said tensioning motor and said tensioning means are automatically actuated in a reverse direction.

In a second aspect, the invention provides a tensioning device for tensioning a strapping band or a lashing band, said device comprising a body, a tensioning motor, and a tensioning means, in which said tensioning motor is operatively connected to said tensioning means, and wherein the device further comprises a tangible non-transitory computer-readable storage medium and a processor, said storage medium comprising instructions which, when executed by the processor, cause the device to carry out the step of actuating said tensioning motor in a tensioning direction, thereby driving said tensioning means. In particular, said storage medium further comprises instructions which, when executed by the processor, cause the device to automatically actuate said tensioning motor and said tensioning means in a reverse direction, as soon as a predetermined tension level has been reached. Optionally, the current (I), voltage (V), and/or motor speed can be used for determining whether the tool has reached a given maximum tension (see below). However, the invention is not limited thereto.

The tensioning device as described throughout this document may or may not be especially adapted for performing the method as described throughout this document. The method as described throughout this document may or may not employ the device as described throughout this document. Therefore, characteristics of the device and method are interchangeable, and the corresponding advantages similarly apply.

It may or may not be possible to switch the tensioner between an automatic mode (in which the motor is automatically reversed, as provided for by the present invention), and a manual mode (in which the motor is not automatically reversed). Switching between modes may in some non-limiting embodiments be done via a direct user interface comprised by the tensioning device, or via a mobile user device that is communicatively paired to the tensioning device. In a possible, non-limiting embodiment, the device may provide a manually operable reverse button or switch, which is advantageous for situations in which the user is forced to stop tensioning.

The maximum tension can be programmed into the drive electronics. This means that more than one maximum tension force can be programmed into the drive electronics, and can be selected using a user interface control element. As such, the reverse functionality can be activated, further depending on a setting selected by a user.

According to a non-limiting embodiment, even in automatic mode, the tensioning device can be stopped at any time. For instance, a tensioning device can be conceived, which device is activated (for automatically tensioning up to a predetermined tension level, and for subsequently reversing the motor and tensioning means) by depressing and releasing an actuation switch. At any time during tensioning, the tensioning device can be stopped by again depressing and releasing said actuation switch. Also, at any time during tensioning, the tensioning device can be operated in reverse by depressing and holding the actuation switch. The actuation switch could or could not function as an emergency stop. A separate emergency stop may or may not be provided. However, the invention is generally not limited to tensioning devices that can always be stopped in automatic mode.

Apart from a normal actuation switch, the tool may also have a separate reverse button. This reverse button would operate normally next to the functionality described in this invention. The reverse can be programmed to run at the same or lower speed compared to the normal 'run' speed. However, the reverse button can also be made smart. E.g. a short engage of the reverse button would result in automatically positioning the windlass in its ideal position to apply the band (see below). This position can be pre-programmed. This position can also be programmable, e.g. by rotating (using the reverse button) the wind lash into the desired position and subsequently engaging a program button, or by pressing both the reverse and forward buttons at the same time for a number of seconds. The invention is generally not limited thereto, however.

The invention is generally not limited to battery-driven tensioning devices. For instance, the device could be driven electrically, pneumatically, hydraulically, or via any combination thereof. Preferably, however, the device at least has a processor that is driven electrically. For instance, one could envision that a mechanical equivalent is designed for obtaining automatic reverse in case of pneumatic of hydraulic motors. The airflow, fluid flow, and/or pressure (in the flow into the motor and/or the flow through a pressure valve) indicate when the motor has reached its maximum can be used as a means to activate a reverse automatically. It is similar to using current and motor speed, in case of an electro motor. The invention is not limited to any of these.

A further or alternative embodiment allows for wireless communication between the tensioner and a mobile user device (e.g. a smartphone). All kinds of data may or may not be collected by the tensioner and/or the mobile user device. For instance it could be possible to collect performance data. For instance it could be possible to collect operating parameters (e.g. introduced by a user in his smartphone). All kinds of collected data may or may not be consulted from an application program running on said mobile user device. All kinds of operating parameters may or may not be manipulated via an application program running on said mobile user device.

Said communication may or may not include the mobile user device sending information towards the tensioning device. Non-limiting examples may comprise information relating to a user selecting a specific tensioning program, relating to the user specifying a desired setting of the tensioning device, relating to the user specifying a band type and/or sealing type that is employed, and/or relating to the user specifying a desired tension level. Said communication may or may not include the tensioning device sending information to the mobile user device. Non-limiting examples may comprise information relating to a service interval, relating to a remaining battery power, and/or relating to a number of cycles. The invention is not limited to any of these. In a possible embodiment said wireless communication may include bidirectional communication between the mobile user device and the tensioning device.

Said communication may be a wireless type of communication or a hardwired communication. Said communication may provide any kind wireless communication, according to any suitable communication protocol. Non-limiting embodiments may include WIFI, Bluetooth, and/or infrared. In some embodiments, it may be possible to remotely monitor and/or control the tensioner. In a particularly preferred embodiment, at least the predetermined tension level may be adjusted by the user, by means of a mobile user device. However, the invention is not generally limited thereto.

According to a further or alternative embodiment, the number of tensioning actions (that is, the number of bands that have been tensioned) performed by the tool is tracked. Optionally, the tensioner could provide a preventive maintenance indicator that indicates whether maintenance is required, based on said count. Optionally, such maintenance could be recommended to the user by an application software running on a mobile user device, based on said count.

According to a further or alternative embodiment, the mobile user device and/or the tensioning device may communicate (e.g. wirelessly or hardwired) with any number of further devices. For instance, a tension sensing device (=force indicator) may further communicate with the user device and/or tensioning device, latter tension sensing device interacting with (or being comprised by) a band and measuring an actual tension level in said band.

According to a non-limiting embodiment, an external tension sensing device may directly engage a main portion of the band, or may even be comprised by said band.

In a further or alternative embodiment, an integrated tension sensing device may be comprised by the tensioning device—thus integrated in the tool itself (see below). Tension may be determined directly via a direct tension sensing device, or may be calculated indirectly.

Either the external device communicates:

The measured tension, upon which the drive electronics determine and calculate when to reverse, or A stop signal once a certain tension is reached, upon which the drive electronics reverse immediately.

The invention is generally not limited to any of both, however.

According to a further or alternative embodiment, an identification device provided to, or in the neighborhood of the lashing or strapping. The lashing or strapping system may exchange identification information with the tensioning device and/or any number of mobile user devices (e.g. of users taking care of tensioning, transport, survey, . . . ). In a possible, non-limiting embodiment, such an identification device may comprise an RFID-tag. However, the invention is not limited thereto.

This is especially interesting if different maximum tensions are at play, depending on the loading plan, wherein the battery tensioner and tension measuring device need to interact in accordance to the loading plan. In particular, one or more of these devices need to be 'aware' of the maximum tension. However, the invention is not limited thereto Quite advantageously, data relating to individual lashing or strapping bands may be collected and stored. Such information may comprise, but is generally not limited to: the tension that has been applied to a specific band, the position of the band, the type of band, the type of buckle that has been applied, etc. Such information may be stored (e.g. locally or in the cloud). Such information may be made available to users, for the sake of inspection, certification, etc. The invention is not limited thereto.

A cutting mechanism may or may not be present for cutting the free end portion of the lashing band or strapping band. Referring to the above, such a cutting mechanism is not required for releasing the free end portion from the tensioning means (e.g. slotted windlass), since the tensioning means is immediately and automatically reversed.

In a further or alternative embodiment, the actual tension level (e.g. based on the current drawn by the tensioning motor, or based on a direct measurement via a tension sensing device) is compared to the predetermined or desired tension level.

Optionally, the actual tension level is determined indirectly, by the tensioning device itself. To such end, the device collects and/or combines information that allows for determining an actual tension in the band, preferably in a main portion of the band. Tension in the band will largely depend on the torque generated by the motor, taking into account the gear ratio, and taking into account the tensioning means diameter and the number of band layers wrapped around said tensioning means (in case of a windlass). Motor torque can be measured via the motor speed and motor current. Optionally, any kind of efficiency losses in the motor, gearbox, possible worm wheels, tensioning means, and/or in the buckle may be taken into account. In particular, the tension level may take into account a tension level drop between the main portion of the band that enters the buckle (that is, the loop of band being tensioned around the goods or load), and the free end portion of the band that leaves the buckle, due to interaction between band and buckle. The skilled person will confirm that such tension level drop may be estimated, measured, or determined in any other way. In doing so, information relating to the buckle (material, shape, size, roughness, . . . ), and band (material, thickness, elongation, compressibility, . . . ) may optionally be taken into account. The motor speed could be calculated from a pulse count of pulses collected by Hall sensors coupled to the motor.

Slipping of the band under the gripper foot may be taken into account. The battery capacity, remaining power, and lifetime may be taken into account. Optionally, also the temperature (e.g. in relation to the motor efficiency) is taken into account.

For instance, according to a non-limiting embodiment, an actual tension level may be determined using information chosen from the group of: a motor characteristic, a current level, a current speed, a type or model of motor transmission, a type or model of windlass, a type of lashing or strapping band (e.g. band material and thickness), a type of buckle (e.g. a surface roughness and buckle loss), a buckle-band configuration, etc. The invention is not limited to any of these. The actual tension level may be computed by an application software program running on a mobile user device, and/or by a processor of the tensioning device itself. At least some of the information may be derived from a loading plan fed into or selected from said application software program. However, this is not necessarily so.

Additionally or alternatively, the actual tension level is directly measured, preferably in a main portion of the band, via a direct tension sensing device. The direct tension sensing device may be attached to the tensioning device (e.g. in the neighborhood of the gripper foot). Alternatively, an external tension sensing device (=external force indicator) is employed.

Optionally, the predetermined tension level is set by a user. Additionally or alternatively, the predetermined tensioning level may be determined based on information w.r.t. the load and lashing/strapping system, for instance based on information contained in the loading plan. When using the invention for strapping or lashing a load, said predetermined tension level should preferably ensure a safe lashing/strapping.

Information that may be included for determining said predetermined tension level are:

information relating to the buckle (type, material, shape, size, roughness, . . . ), information relating to the band (material, thickness, elongation, compressibility, band length, linear breaking strength, . . . ), and information relating to the lashing or strapping system (mutual position of band and buckle, settling/slipping, system breaking strength, length of the lashing/strapping, compressibility of the load, . . . ).

At least a part of this information may be loaded automatically from identification tags provided on the system, for instance on the bands or buckles. Additionally or alternatively, at least a part of this information may be derived from a loading plan. Additionally or alternatively, at least a part of this information may be measured directly or indirectly.

Generally, a loss in tension over time, equal to one third of the initial tension level may be taken into account when determining said predetermined tension level.

In a further or alternative embodiment, the tensioning means is a rotary tensioning means such as a tensioning wheel or a slotted windlass. A slotted windlass is particularly useful for tensioning a lashing band through a lashing buckle. The motor being "operatively connected to" the tensioning means, corresponds to the motor being adapted for driving said tensioning means. In case the tensioning means is a rotary tensioning means, the motor is preferably adapted for rotating said tensioning means.

The device may or may not comprise a fixation means for substantially maintaining the position of the device w.r.t. the buckle and/or band. Possible embodiments involve a "gripper foot" that may be clamped onto a main portion of the band, a bypass arm that bypasses the buckle and that engages a second free band portion, opposite to the first, or an abutment member that abuts the buckle during tensioning. The invention is not limited to any of these.

In a further or alternative embodiment, the automated method according to the invention comprises the steps of (i) clamping a main portion of the band (e.g. by means of a gripper foot), (ii) tensioning the band via the tensioning means, and (iii) automatically actuating the tensioning motor and tensioning means in reverse direction, while subsequently and/or simultaneously unclamping said main portion of the band. In possible embodiments, the main portion of the band is unclamped only subsequently to said actuation in reverse.

In a further or alternative embodiment, the tensioning means is a slotted windlass that is rotably driven by said tensioning motor. As soon as said predetermined tension level has been reached, the windlass is driven in reverse, back into a starting position for the windlass. Optionally, the latter involves determination of the windlass rotational position. Possible suitable "starting positions" are as specified below.

Optionally, the windlass is driven in reverse for a sufficient number of reverse rotations, so as to sufficiently unwind the band from the windlass. The latter could allow for conveniently disengaging the free end portion of the band. The number of reverse rotations may be less than one, equal to about one, or more than one, depending on the band type and tension level. Optionally, the tensioning device is measuring the angular distance traveled by the tensioning means during tensioning (e.g. by means of Hall sensors—see below). Based on this measurement, the tensioning device is able to determine said sufficient number of reverse rotations.

Determining the windlass rotational position may be done by means of Hall sensors that are sometimes used for determining the position of direct current motor rotors. Optionally, one or more Hall sensors may be used for determining the position of the rotor, and therefore also for determining the position of the windlass (since the latter is mechanically connected to said rotor). A starting position for the windlass may correspond to the most convenient position for unfeeding, and (if required) for refeeding the band material. This will save time (no manual operation to reverse, no manual repositioning of the windlass).

In doing so, the motor management system takes care that once achieving the desired or maximum tension, the motor rewinds automatically in order to take out the band, and preferably into an optimal position for (re)feeding. The optimal starting/unfeeding/(re)feeding position may relate to the slotted windlass providing a diagonal slot that extends into a 0°-90° angle w.r.t. the band direction of extension, and substantially away from the buckle. Preferably the angle has a value of between 0°-90°, more preferably between 5°-85°, more preferably between 10°-80°, more preferably between 15°-75°, more preferably between 35°-55°. E.g. substantially 20°, 30°, 40°, 50°, 60°, or 70°. In particular said angle may be about 45°.

In a further or alternative embodiment, the tensioning motor and tensioning means (not necessarily a slotted windlass) are driven in reverse, at least until the tension has been lowered to a predetermined reduced tension level. In a further or alternative embodiment, the tensioning motor and tensioning means (not necessarily a slotted windlass) are driven in reverse, at least for a predetermined amount of time. The invention is generally not limited thereto.

In one possible, non-limiting embodiment, depressing and releasing an actuation switch commences the operating cycle. The band is tensioned and the free end portion of the band is immediately subsequently, and actively relaxed. In particular, an intermediate sealing cycle is not required, since a self-locking buckle is employed. Also, it is not necessary to provide some kind of brake mechanism for maintaining tension while at the same time relieving the motor. In general such brake mechanism may or may not be present. Of course, the mechanism may be activated automatically or in any other way, not limited to depressing and releasing some actuation switch.

According to a further or alternative embodiment, the power generated by the motor (i.e. as a result of the motor acting as a generator) may be used for further purposes, for instance but not limited to reversing the drive.

The invention is further described by the following non-limiting examples which further illustrate the invention, and are not intended to, nor should they be interpreted to, limit the scope of the invention.

FIG. 1 represents a tensioning device 1 according to an embodiment of the invention, used for tensioning a band 2, 3 around an object 4. A main portion 2 of the band 2, 3 forms a band loop around the object 4. The loop is closed by means of a self-locking buckle 5. In the present case said buckle 5 is a wire buckle. Note that wire buckles are often used for strapping. In lashing, by contrast, ladder buckles are rather employed. However, the invention is not limited to any of both.

The buckle 5 has two strap-engaging portions 6. Corresponding free end portions 3 of the band 2, 3 leave the buckle 5 in substantially opposite directions. The loop formed by said main portion 2 can now be tensioned, by applying a tensioning force to at least one of the free end portions 3. In doing so, said end portion 3 is pulled through the buckle 5. The loop is tightened.

The tensioning device 1 comprises a body 7, a tensioning motor (not shown), and a tensioning means 8. A rotary tensioning means 8 in the form of a slotted windlass 8' is shown. The tensioning device 1 further comprises a bearing plate 9 and a gripper foot 10 by which it can be clamped to said main portion 2 of the band 2, 3.

For the sake of tensioning the band 2, 3, a free end portion 3 of the band 2, 3 is led through a guiding means 11 of the device 1, and subsequently fed to the slotted windlass 8'. More specifically, the free end portion 3 of the band 2, 3 is inserted into a slot 12 of said slotted windlass 8'. Now, upon actuating the motor in its tensioning direction, the slotted windlass 8' will be rotated in its tensioning direction, resulting in the band 2, 3 being tensioned. Latter tensioning direction may be clockwise or counterclockwise.

In particular, as soon as a predetermined tension level has been reached, the tensioning motor and the slotted windlass 8' are automatically actuated in reverse direction, opposite to said tensioning direction. In doing so, the free end portion 3 of the band 2, 3 is relaxed. Tension in the main portion 2 of the band 2, 3 is substantially maintained by the buckle 5.

Optionally, the windlass 8' is automatically driven in reverse, back into a starting position for the windlass 8'. A possible starting position is shown in FIG. 1. It preferably corresponds to the most convenient position for unfeeding and refeeding the band 2, 3. In particular, the aforementioned slot 12 has a direction 13 that extends into an angle 14 of about 45° w.r.t. the main band direction 15 of extension, substantially away from the buckle 5.

Optionally, the windlass 8' is automatically driven in reverse for more than one revolution, such that the free end portion 3 of the band is sufficiently relaxed for easy withdrawal.

Figure 2:
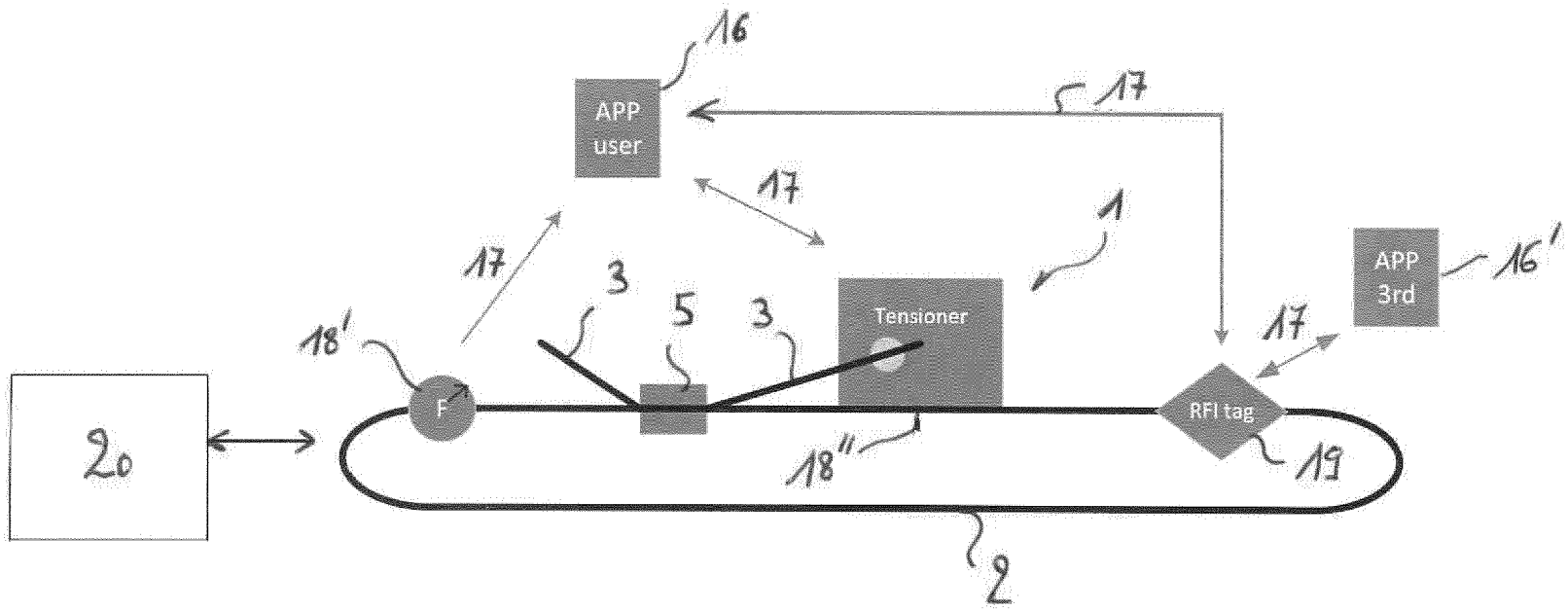
FIG. 2 gives a schematic overview of the a band being tensioned through a self-locking buckle by means of a tensioning device. The tensioning device may interact with a number of further devices.

FIG. 2 gives a schematic overview of a band 2, 3 being tensioned through a self-locking buckle 5, by means of a tensioning device 1. To such end, a free end portion 3 of the band 2, 3 is fed to a tensioning means 8 (e.g. slotted windlass 8') of the tensioning device 1. The tensioning device 1 itself is clamped to a main portion 2 of the band 2, 3.

The tensioning device 1 may interact with a number of further devices. First of all, the tensioning device 1 may be communicatively paired 17 to a mobile user device 16 of the person applying the lashing/strapping. Latter device 16 may for instance be a smartphone or tablet. Via an application program running on said mobile user device 16, one or more operating parameters may be set (for instance a predetermined tension level), and one or more performance data may be consulted (for instance indicating the progress in tensioning a band). The tensioning device 1 may be partly controlled from said mobile user device 1. Preferably, there is a bidirectional communication 17 between the tensioning device 1 and the mobile user device 16.

The mobile user device 16 may further collect information from a direct pressure sensing device 18. The latter may be an external device 18', and/or a device 18" attached to the tensioning device 1. In any case, such direct pressure sensing devices 18 preferably interact directly with the main portion 2 of the band 2, 3. Preferably, there is at least a one-directional communication 17, from the pressure sensing device 18 towards the mobile user device 16.

The mobile user device 16 may further interact with one or more identification devices 19 such as RFID tags. Preferably, the identification devices 19 comprise electronically stored information. Identification devices 19 may be provided to the buckle 5 and/or band 2, 3. Optionally, they could allow the application to verify whether the right type of bands/buckles have been employed. Optionally, they could allow the application to store individual tensioning information to each band/buckle. Preferably, there is a bidirectional communication 17 between the mobile user device 16 and such identification devices 19.

Further devices 20 can be envisaged for exchanging information with any of the devices discussed above.

Also, a second mobile user device 16' could be paired to the identification device 19, for consulting the information stored thereon. This may be advantageous for certification and/or approval of the resulting lashing/strapping.

The numbered elements on the figures are:

1. Tensioning device
2. Main portion of band
3. End portion of band
4. Object
5. Buckle
6. Strap-engaging portion
7. Body
8. Tensioning means
9. Bearing plate
10. Gripper foot
11. Guiding means
12. Slot
13. Slot direction
14. Angle
15. Main direction
16. Mobile user device
17. Wireless communication
18. Pressure sensing device
19. Identification device
20. Further devices The present invention is in no way limited to the embodiments described in the examples and/or shown in the figures. On the contrary, methods according to the present invention may be realized in many different ways without departing from the scope of the invention.

The invention claimed is:

1. A method for tensioning a band comprising a strapping band or a lashing band threaded through a self-locking buckle, the method comprising:

engaging a free end portion of a band by a tensioning means of a tensioning device, said tensioning device comprising a tensioning motor operatively connected to said tensioning means;

tensioning said band by actuating said tensioning motor in a tensioning direction, thereby driving said tensioning means, and thereby pulling said free end portion of the band through a self-locking buckle; and driving the tensioning means of the tensioning device in a reverse direction to a starting position for the tensioning means when a predetermined tension level is reached.

2. The method of claim 1, wherein said tensioning means comprises a slotted windlass configured to be rotatably driven by said tensioning motor.

3. The method according to claim 1, further comprising determining an actual tension level, wherein said actual tension level is compared to said predetermined tension level to determine when the predetermined tension level is reached.

4. The method of claim 3, wherein the determining said actual tension level is based on a current level drawn by said tensioning motor.

5. The method of claim 3, wherein the determining said actual tension level is based on a tension sensing device interacting with the band.

6. The method according to claim 1, wherein said tensioning device is communicatively paired to a mobile user device, in which one or more operating parameters of the tensioning device are set by means of said mobile user device, and/or in which performance data in relation to the tensioning device is consulted from said mobile user device.

7. The method of claim 6, wherein said predetermined tension level is adjusted by a user, by means of said mobile user device.

8. The method of claim 6, wherein said predetermined tension level is automatically determined based on a loading plan fed into, or selected from said mobile user device.

9. A method for tensioning a strapping band or a lashing band, which band is threaded through a self-locking buckle, and wherein said method comprises the steps of:

engaging a free end portion of the band via a tensioning means of a tensioning device, said tensioning device comprising a tensioning motor operatively connected to said tensioning means, and tensioning said band by actuating said tensioning motor in a tensioning direction, thereby driving said tensioning means, and thereby pulling said free end portion of the band through said buckle, characterized in that, as soon as a predetermined tension level has been reached, said tensioning motor and said tensioning means are automatically actuated in a reverse direction, wherein said tensioning means is a slotted windlass that is rotatably driven by said tensioning motor, and wherein, as soon as said predetermined tension level has been reached, the windlass is automatically driven in reverse, back into a starting position for the windlass.

10. A tensioning device for tensioning a band comprising a strapping band or a lashing band, the tensioning device comprising:

a body;

a tensioning means configured to engage the band;

a tensioning motor operatively connected to said tensioning means;

a tangible non-transitory computer-readable storage medium; and a processor, wherein said storage medium comprises instructions which, when executed by the processor, cause the tensioning device to:

actuate said tensioning motor in a tensioning direction, thereby driving said tensioning means;

actuate said tensioning motor and said tensioning means in a reverse direction; and drive said tensioning motor and said tensioning means in the reverse direction to disengage the band when a predetermined tension level is reached.

11. The tensioning device of claim 10, wherein said tensioning means comprises a slotted windlass rotatably coupled to said tensioning motor.

12. The tensioning device according to claim 10, further comprising a user interface for setting one or more operating parameters of the tensioning device, and/or for consulting performance data in relation to the tensioning device.

13. The tensioning device according to claim 10, further comprising a wireless communication module adapted for communication with a mobile user device.

14. The tensioning device according to claim 10, wherein:

the tensioning means is configured to engage a free end portion of the band;

the tensioning device is configured to tension said band by actuating said tensioning motor in the tensioning direction, thereby driving said tensioning means, and thereby pulling said free end portion of the band; and the tensioning device is further configured to disengage the band by automatically actuating said tensioning motor in the reverse direction when the predetermined tension level is reached.

15. The tensioning device according to claim 10, wherein, when the predetermined tension level is reached, the tensioning means is automatically drive reverse, back into a starting position for the tensioning means.

16. The tensioning device according to claim 15, wherein said tensioning means comprises a tensioning wheel or a slotted windlass configured to be rotatably driven by said tensioning motor.

17. The tensioning device according to claim 10, wherein, when the predetermined tension level is reached, the tensioning means is automatically driven to a feeding position.

18. A tensioning kit comprising the tensioning device of claim 10 for tensioning the comprising the strapping band or the lashing band, said kit comprising at least one tension sensing device.

* * * * *